US007316193B1

(12) United States Patent
Greenbaum

(10) Patent No.: US 7,316,193 B1
(45) Date of Patent: Jan. 8, 2008

(54) VESSEL FOR WATER TRAVEL

(75) Inventor: Jay Scott Greenbaum, Hickory, NC (US)

(73) Assignee: HydroEye Marine Group, LLC, Hickory, NC (US)

( * ) Notice: Subject to any disclaimer, the term of this patent is extended or adjusted under 35 U.S.C. 154(b) by 0 days.

(21) Appl. No.: 11/118,580

(22) Filed: Apr. 29, 2005

(51) Int. Cl.

| | |
|---|---|
| ***B63B 39/00*** | (2006.01) |
| ***B63B 39/03*** | (2006.01) |
| ***B63B 1/10*** | (2006.01) |
| ***B63B 1/18*** | (2006.01) |
| ***B63B 1/32*** | (2006.01) |

(52) U.S. Cl. ..... 114/125; 114/61.1; 114/122; 114/288; 114/290

(58) Field of Classification Search ..... 114/121–126, 114/288–290, 292, 56.1, 61.1–63, 345
See application file for complete search history.

(56) References Cited

U.S. PATENT DOCUMENTS

| | | | | |
|---|---|---|---|---|
| 1,794,474 | A * | 3/1931 | Von Miller | 244/105 |
| 2,366,035 | A * | 12/1944 | Leone | 114/61.27 |
| 2,757,629 | A * | 8/1956 | Wiltse | 114/125 |
| 3,111,924 | A * | 11/1963 | Ecroyd et al. | 114/283 |
| 3,968,762 | A | 7/1976 | Meyer, Jr. | 114/66.5 H |
| 3,968,763 | A | 7/1976 | Mason | 114/67 A |
| 4,031,841 | A | 6/1977 | Bredt | 114/67 A |
| 4,090,459 | A | 5/1978 | Chaplin | 114/67 A |
| 4,141,309 | A | 2/1979 | Halboth | 115/70 |
| 4,165,701 | A | 8/1979 | Kluytmans | 114/61 |
| 4,165,703 | A | 8/1979 | Burg | 114/67 A |
| 4,169,514 | A | 10/1979 | Wheeler et al. | 180/127 |
| 4,228,752 | A | 10/1980 | Sladek et al. | 114/67 A |
| 4,231,131 | A | 11/1980 | Young | 9/2 C |
| 4,254,729 | A * | 3/1981 | Muller | 114/280 |
| 4,284,024 | A | 8/1981 | Montgomery | 114/61 |
| 4,301,758 | A | 11/1981 | Riviere | 114/61 |
| 4,340,004 | A | 7/1982 | Kanei | 114/67 A |
| 4,506,618 | A | 3/1985 | Chaplin | 114/67 A |
| 4,528,927 | A | 7/1985 | Iizuka et al. | 114/125 |
| 4,603,651 | A | 8/1986 | Harding | 114/345 |
| 4,660,492 | A | 4/1987 | Schlichthorst et al. | 114/67 A |
| 4,702,189 | A | 10/1987 | Schlichthorst | 114/61 |
| 4,708,077 | A | 11/1987 | Balquet et al. | 114/67 A |
| 4,823,726 | A | 4/1989 | Pennati | 114/345 |
| 4,870,919 | A | 10/1989 | Allison | 114/61 |
| 4,926,773 | A | 5/1990 | Manor | 114/61 |
| 4,936,237 | A | 6/1990 | Walters | 114/61 |

(Continued)

FOREIGN PATENT DOCUMENTS

GB 544239 A * 4/1942

(Continued)

*Primary Examiner*—Ajay Vasudeva
(74) *Attorney, Agent, or Firm*—Kennedy Covington Lobdell & Hickman, LLP

(57) ABSTRACT

A vessel for water travel that has the stability of a heavy weighted vessel when at rest in the water and the performance of a lightweight vessel when in a planed condition. The vessel comprises at least one hull structure for partially submerged flotation in a body of water and at least two hull elements affixed to or a structural part of the hull structure. The hull structure may further comprise laterally spaced hollow ballast devices that rare open at respective fore and aft ends, thus providing stability when submerged in the water and performance by the evacuation of water when in a planed condition.

13 Claims, 5 Drawing Sheets

U.S. PATENT DOCUMENTS

| | | | | |
|---|---|---|---|---|
| 4,936,242 | A | 6/1990 | Stelniceanu | 114/352 |
| 4,938,162 | A | 7/1990 | Hanlon | 114/61 |
| 4,996,935 | A | 3/1991 | Takeuchi | 114/61 |
| 5,259,331 | A | 11/1993 | Hagan | 114/61 |
| 5,301,624 | A | 4/1994 | Hall et al. | 114/61 |
| 5,377,608 | A | 1/1995 | Harper, Jr. | 114/61 |
| 5,492,076 | A | 2/1996 | Kobayashi | 114/362 |
| 5,522,333 | A | 6/1996 | Lang et al. | 114/61 |
| 5,544,612 | A | 8/1996 | Eymard | 114/345 |
| 5,570,649 | A | 11/1996 | Austin | 114/61 |
| 5,645,003 | A | 7/1997 | Grinde | 114/125 |
| 5,839,384 | A | 11/1998 | Burg | 114/67 A |
| 6,085,677 | A | 7/2000 | Bell | 114/61.1 |
| 6,131,529 | A | 10/2000 | Smith | 114/271 |
| 6,138,602 | A | 10/2000 | Cary | 114/288 |
| 6,159,058 | A | 12/2000 | Matheson | 440/12.5 |
| 6,186,086 | B1 | 2/2001 | Zender et al. | 114/271 |
| 6,247,422 | B1 | 6/2001 | Murray, III | 114/271 |
| 6,293,216 | B1 | 9/2001 | Barsumian | 114/67 A |
| 6,338,307 | B1 * | 1/2002 | Pires | 114/61.1 |
| 6,394,014 | B1 | 5/2002 | Waldock | 114/61.1 |
| 6,425,341 | B1 | 7/2002 | Devin | 114/288 |
| 6,435,123 | B1 | 8/2002 | Ødegård | 114/274 |

FOREIGN PATENT DOCUMENTS

| | | | |
|---|---|---|---|
| GB | 0972196 | A * | 10/1964 |
| GB | 2219973 | A * | 12/1989 |
| JP | 02262492 | A * | 10/1990 |
| JP | 05338587 | A * | 12/1993 |

* cited by examiner

VESSEL FOR WATER TRAVEL

FIELD OF THE INVENTION

The present invention relates to a vessel for water travel, more particularly to a vessel that has the stability of a heavy weighted vessel when at rest in the water and the performance of a lightweight vessel when in a planed condition.

BACKGROUND OF THE INVENTION

The majority of manufactured boats currently are of a "V" bottom configuration. As such they possess large wetted surfaces contributing to a high viscous drag coefficient and other less than desirable characteristics. At rest they become very unstable and "tippy", and in movement require substantial power to attain acceptable speed. The "V" design is not very efficient when compared to performance or stability of other boat designs.

There are also power boats in the marketplace that are of the pontoon, trimaran or catamaran configuration. A main disadvantage of such vessels is the lack of a guidance control surface for liquid flow beneath the center line of the craft. The catamaran hulls create a fluid dynamic flow very unstable making positioning of the onboard propulsion source and anti-cavitation plane very difficult. Unstable aerated water flow at the point of propulsion contributes to power loss, high fuel consumption, and reduced predictable control of the vessel.

Performance power boats, by nature, are lightweight vessels. They uniformly lack the stability of larger ballasted vessels. Thus, there is a need for a water craft that has the performance attributes of a lightweight boat yet the stability of a heavyweight ballasted vessel. There is especially a need for such a vessel as an emergency water craft for use in less than desirable weather conditions.

SUMMARY OF THE INVENTION

The present invention is directed to a vessel for water travel that has the stability of a heavy weighted vessel when at rest and during low speed operation in the water and the performance of a lightweight vessel when in a planed condition.

The vessel comprises at least one hull structure for partially submerged flotation in a body of water, and the hull structure comprises at least two elongated hollow ballast devices in a laterally spaced fore and aft orientation to be at least partially submerged in a resting condition of the vessel. The hollow ballast devices may be affixed to or a structural part of the hull structure. Each elongated hollow ballast device is open at its fore and aft ends to be occupied by the water in the resting condition and to evacuate the water when the vessel is moving over the water in a planed condition.

In another aspect of the present invention, the vessel comprises at least one hull structure for partially submerged flotation in a body of water, and the hull structure comprises at least two hull elements in a laterally spaced fore and aft orientation. The at least two hull elements may be affixed to or a structural part of the hull structure. The hull elements may further comprise hollow ballast devices.

Another feature of the present invention is that the hull structure may further comprise a sponson located on the underside of the hull structure between the hull elements. Tunnels are formed between the sponson and the hull elements providing a channel to facilitate air lift.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF THE PREFERRED EMBODIMENTS

The following description of the preferred embodiment(s) is merely exemplary in nature and is in no way intended to limit the invention, its application, or uses.

The present invention relates to a vessel for water travel. The vessel may be an inflatable, semi-rigid or fully rigid vessel. The vessel comprises at least one hull structure for partially submerged flotation in a body of water. The hull structure comprises at least two hull elements. The hull elements are affixed to or a structural part of the hull structure in a laterally spaced fore and aft orientation. The hull structure further comprises at least two elongated hollow ballast devices. In one aspect of the present invention, each elongated hollow ballast device may be affixed to or comprise a structural part of a respective one of the hull elements. The ballast devices are at least partially submerged in a resting condition of the vessel with each elongated hollow ballast device being open at its fore and aft ends to be occupied by the water in the resting condition. The ballast devices also evacuate the water when the vessel is moving over the water in a planed condition channeling air below the hull in a fore-to-aft direction, and preventing air from escaping laterally from the air space relative to the direction of movement to form a seal with respect to the body of water. The elongated hollow ballast devices may be of the same size or of varying size.

The hollow ballast devices are open for water ballast storage when at rest and for water evacuation upon acceleration. The ballast devices of the vessel are open to the aquatic environment allowing water to freely flow through them when submerged but yet to evacuate the water from them upon acceleration, transitioning the vessel from a heavy to a lightweight vessel. The ballast devices can also serve as keels to assist in directing or steering the vessel. Thus, the vessel of the present invention has the performance advantages of a lightweight vessel but also has the stability advantages of a heavy ballasted vessel. Preferably, the vessel has a hull structure similar to a pontoon, a catamaran, or a trimaran.

The hull structure typically is wide due to the presence of multiple hull elements. A wide hull structure is advantageous for placement of a control console to accommodate a user's needs while haying minimal negative effect on vessel performance. The vessel may further support an outboard or inboard power source, searchlight, other equipment or storage.

Figure 1:
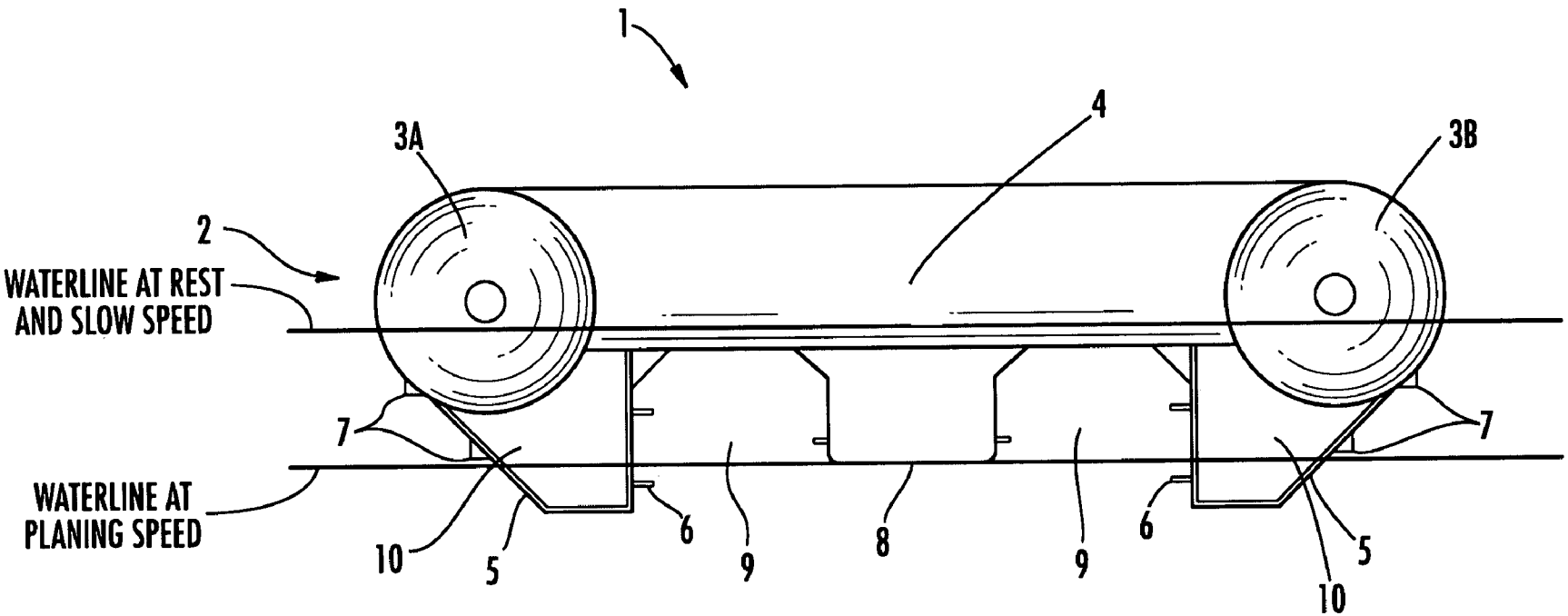
FIG. 1 is a rear view of a vessel of the present invention.
Figure 2:
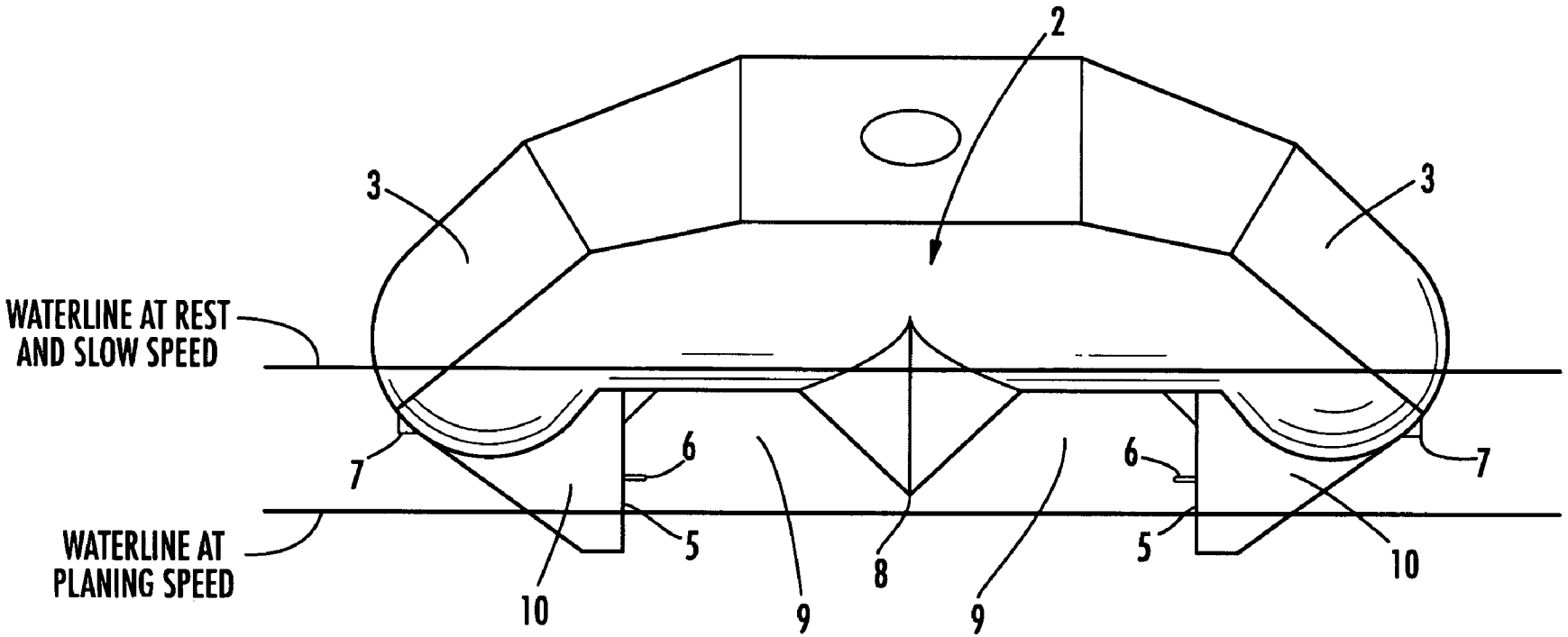
FIG. 2 is a front view of a vessel of the present invention.

The vessel of the present invention may further comprise a sponson which is a structure that is affixed to or a structural part of the underside of the hull. Preferably, the sponson runs close to the water as to affect a seal with the water when the vessel is in the planed condition. The sponson separates the hull elements creating air chambers or tunnels between them and the sponson. In the case of a vessel having two hull elements, for example, a sponson separates each of the hull elements creating two air chambers or tunnels between them and the sponson. Preferably, the sponson is centered between the two hull elements. Forward motion of the vessel forces compressed air into these tunnels pressurizing the tunnel cavities and creating lift to reduce wetted surface area. Upon acceleration, air enters from the front of the vessel and is channeled under the hull structure. Air pressure increases as it passes beneath the hull structure. This high pressure air provides the lift necessary to create a dynamic air cushion to properly support the vessel upon the surface of the water. The presence of the sponson adds lift by further compressing the air as it passes under the vessel. In the case of a vessel having a catamaran-type hull configuration, the split tunnel created by the sponson controls the flow of water to maximize thrust efficiency. Furthermore, the split tunnel is responsible for the self-trimming tendencies of the vessel such that any air pressure differential generated in the tunnels by a weight imbalance on the vessel is automatically compensated for by virtue of the split tunnels. The sponson also provides additional interior accommodation for items including, but not limited to, tankage, storage, and bait well. Additionally, as shown in FIGS. 1 and 2, the sponson is closed to water at its ends so as not to fill with water.

The hull elements trap air from escaping through the sides of the vessel and when acting as keels provide control surfaces upon which the vessel depends to vary its course and direction. The configuration of the hull structure also acts as a stabilizer to provide for a smooth ride at speed and a roll control device when the vessel is at rest. At rest and through low speed operation, the hollow ballast devices fill with water enabling characteristics similar to a heavy ballasted vessel. Since the ballast devices are flooded with water while the vessel is at rest and operated in slow speed condition, the added ballast weight stabilizes the vessel inhibiting its ability to roll from port to starboard. As speed is increased, the ballast devices which may further comprise water relief holes empty the water allowing for a smooth transition from rest-to-plane. Rest-to-plane attitude remains relatively flat with very little bow rise of the vessel. The water is at least partially, if not predominantly, evacuated from the ballast devices. At speed and in heavy weather conditions, the hollow ballast devices accept entry of water to assist in maintaining stability, control, and attitude of the vessel. The ballast devices present a narrow cross-section to oncoming seas minimizing added buoyancy presented by aggressive wave action. The vessel maintains speed and its relative angle to the surface of the water as the waves travel through the ballast devices instead of slapping against a large exposed bow section as in a "V" bottom vessel. This minimizes water spray as well as the shock to the vessel when encountering waves. Thus, the vessel is particularly suited for emergency response especially in unfavorable or treacherous weather conditions.

In the case of a vessel having two elongated ballast devices affixed to the hull structure, the vessel may not only have hollow ballast devices but also a sponson between the two hollow ballast devices. Preferably, the sponson is located between the hollow ballast devices on the underside of the vessel. More preferably, the sponson is centered between the hollow ballast devices in the situation where there are two ballast devices.

Guide elements may be affixed to the vessel to further improve the performance attributes of the vessel. Guide elements include, but are not limited to, flow control blades, keels, rudders, fins, and winglets. For example, winglets may assist in keeping the vessel in constant contact with the water to assist in maintaining consistent stability and predictable control. The guide elements may be fixed or moveable to fine tune the vessel to accommodate variable sea conditions and vessel usage. Some of the guide elements only control hydrodynamic forces while others serve a dual purpose in both air and water as they are exposed to both forces. Control of movable guide elements can be manual or by any other means. The vessel may also comprise a spray rail, for example, that may completely surround the vessel or may be selectively positioned to mostly knock down spray caused by the transition of the vessel through the water.

The vessel of the present invention has improved performance and stability characteristics such as increased stability, speed, efficiency, ride characteristics, and control. The vessel allows for better performance such as improved handling, predictable control, and economical benefits. Ballast water filling the ballast devices at rest and low speed operation allows for the lowest freeboard possible in a vessel of this type. Transition to high speed raises the freeboard by dumping the water ballast. As the vessel increases in speed, water is evacuated from the ballast devices and air pressure develops in the tunnels. This causes the vessel to rise higher in the water thereby raising the freeboard distance.

As discussed above, the vessel of the present invention minimizes dynamic forces applied to a vessel to improve speed, handling, and efficiency. In a catamaran-type configuration, the substantially parallel twin keels are split by a sponson to create two air cavities or tunnels beneath the hull structure. Forward motion of the vessel allows air to enter the cavities from the front of the vessel. As power is applied and the vessel increases speed, air pressure is increased in the tunnels. The air compression between the surface of the water and the underside of the vessel within the tunnels causes increased pressure as the air flows to the stern creating a dynamic air cushion bearing the weight of the vessel, thus providing lift. The keels with the sponson seal the air from escaping out the sides of each tunnel providing a sole air entrance point at the front of the vessel and two exit points at the rear of the tunnels. Lifting the majority of the hull structure out of the water minimizes the water contact area, thus reducing the viscous drag on the vessel. The high air pressure within the tunnels provides a dynamic air cushion positively effecting soft ride characteristics, improved handling, and responsive control. By utilizing gas pressure within the two tunnel cavities the vessel can operate at higher speeds and improved efficiency as compared to conventional vessels. No additional power is necessary to run mechanical apparatus such as pumps and blowers to cause the vessel to lift.

The tunnels provide vessel trim benefit by counterbalancing weight distribution aboard the vessel. As weight is unevenly distributed aboard the vessel, the heavier side runs lower in the water, reducing air volume in that tunnel. Reduced volume causes increased air pressure within the tunnel on that side of the vessel. Greater lift is generated by the increased air pressure automatically trimming the vessel without any additional trim devices.

As discussed above, the hollow ballast devices may be affixed to or a structural part of the hull structure in a laterally spaced fore and aft orientation. They may also serve a dual role as a keel. At rest these keels are substantially flooded with water adding substantial ballasted stability to the vessel. At slow speeds these water-ballast keels remain flooded. Forward motion of the vessel immediately begins to effect lift. As the bow begins to rise water is evacuated from the keels through the openings at the stern and sides effecting a planing attitude for the vessel much sooner than would be possible for a fully ballasted conventional vessel. Any water relief holes or openings in the twin keels are functional in providing for a relatively flat initial planning attitude of the vessel. The controlled exit of the ballast water thru the supplied openings in the keels maintain the vessel in a relative parallel relationship to the surface of the water throughout the transition from rest to a fully planed condition. The open keel design helps maintain this mostly flat planing attitude in most sea conditions. As the vessel encounters water chop and heavier seas the open forward ends of the keels present small cross-sections to the oncoming force, thus limiting the force's effect on the forward motion of the vessel. The open forward ends of the keels allow the water to enter under these conditions ballasting the bow to assist in maintaining the flat attitude. The newly acquired water ballast flows through the keels, having little resistance, continually stabilizing the vessel until it exits at the rear. The hollow ballast devices produce the effect of a fully ballasted vessel without the negative effects of always carrying heavy ballast.

Aggressive maneuverability is facilitated by a combination of all of the above. Twin catamaran-type keels in the vessel of the present invention make the vessel ride as if it were on parallel rails. Assisted by its dynamic air cushion lift characteristics, the vessel is extremely light and nimble in its handling. The hollow ballast system and strategic guide elements work together to maintain the stability and predictability of the vessel, and through all maneuvers the vessel stays mostly parallel and flat to the surface of the water. There is no appreciable lean during aggressive turning and the vessel maintains its relative parallel to the water surface attitude at various speeds and transition periods. The present invention provides for the hull structure to remain in contact with the water allowing for consistent predictable control and constant power transmission. Efficiency is maximized as the propulsion remains constant, a significant proportion of the weight of the vessel is supported by generated lift, drag is reduced through limited wetted surface, and hydrodynamic forces are minimized through the presentation of a very small frontal area at the bow.

FIGS. 1 to 5 merely illustrate a preferred configuration of the vessel of the present invention and are not intended to limit the present invention in any respect.

FIG. 1 is a rear view of a vessel in accordance with the present invention. As illustrated in FIG. 1, the vessel 1 has a hull structure 2 that forms a collar 3 surrounding the vessel 1 with the open end of the collar 3 at port and starboard extending past the stern 4. The collar 3 in a "U"-shape providing spaced-apart inflated hull elements 3A and 3B may be constructed of one or more segments and chambers. The hull structure 2 may be inflated, semi-rigid or rigid. The hull structure 2 may comprise other forms of multiple hull elements, e.g., pontoon-style or catamaran-style units, and more than two such units could be utilized as in a trimaran-style unit.

The hull structure 2 comprises hull elements. As shown in FIG. 1, the hull structure 2 also comprises two elongated hollow ballast devices 5 that may be affixed to or a structural part of the hull elements. A sponson 8 is located between the hollow ballast devices 5 and is positioned on the underside of the hull structure 2. The sponson 8 preferably runs at the waterline when the vessel 1 is in a planed condition. The sponson 8 forms tunnels 9 between the sponson 8 and the ballast devices 5. The sponson 8 has a rectangular cross-sectional shape as viewed from the stern 4. The ballast devices 5 which act as keels run mostly parallel to one another.

The vessel 1 may also comprise spray rails 7 and guide elements such as flow control blades 6. As shown in FIG. 1, the flow control blades 6 are preferably positioned on the tunnel side of each of the ballast devices 5 and the sponson 8; however, the flow control blades 6 can be placed at any location on the hull structure 2. The spray rails 7 are located preferably at the water level. As shown in FIG. 1, the spray rails 7 are located on the outside of the ballast devices 5 and the hull structure 2.

FIG. 2 is a front view of the vessel 1 shown in FIG. 1. As illustrated in FIG. 2, a "U"-shaped collar 3 wraps around the bow of the vessel 1. The sponson 8 has a "V"-cross-sectional shape as viewed from the bow of the vessel 1. The sponson 8 eases the water entry in heavy seas and opens the twin tunnels 9 to greater volume of air, allowing for compression of air as it passes underneath the hull structure 2. The hollow ballast devices 5 narrow at the bow reducing the water contact surface area. The fore and aft openings 10 in the hollow ballast devices 5 allow for water entry into the ballast device 5 at rest and slow speed, and reduce hull resistance to both hydrodynamic and aerodynamic forces at planing speeds. Spray rails 7 knock down water spray at virtually all speeds, and flow control blades 6 aid to redirect water and/or air flow within the tunnels 9.

Figure 3:
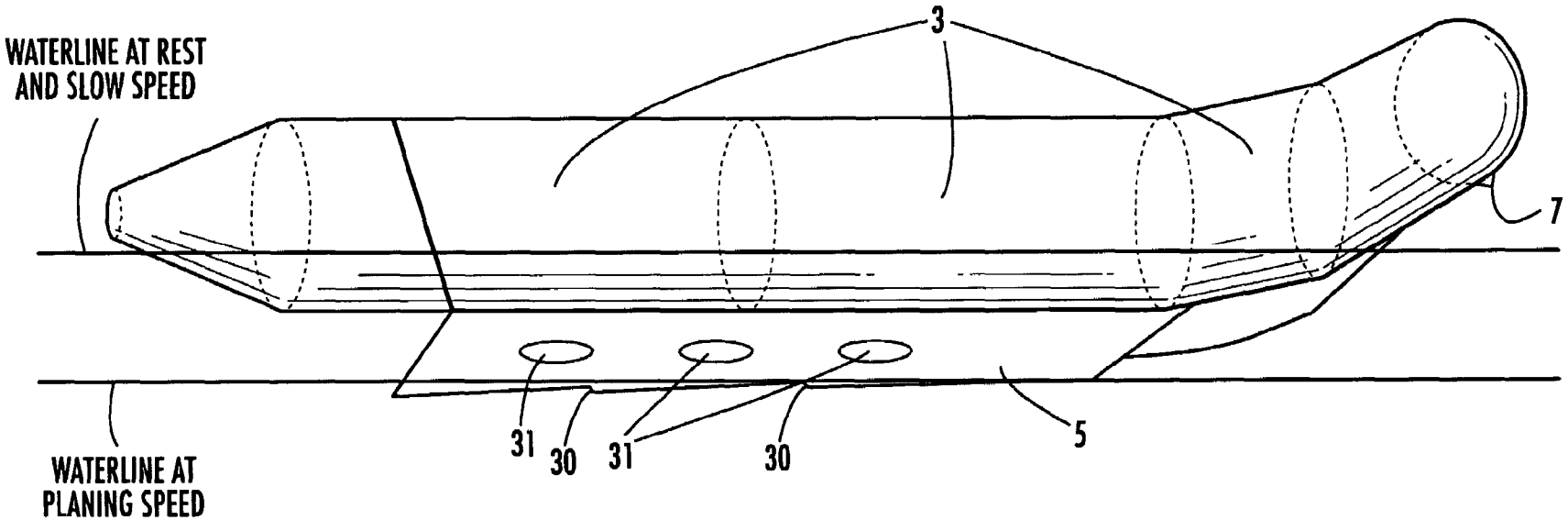
FIG. 3 is a side view of a vessel of the present invention.

FIG. 3 is a side view of the vessel shown in FIG. 1. As illustrated in FIG. 3, the hull structure 2 comprises the "U"-shaped collar 3. Relief steps 30 aid to break water adhesion to the ballast devices 5. Relief holes 31 aid fore and aft openings 10 to dump water from the ballast devices 5.

Figure 4:
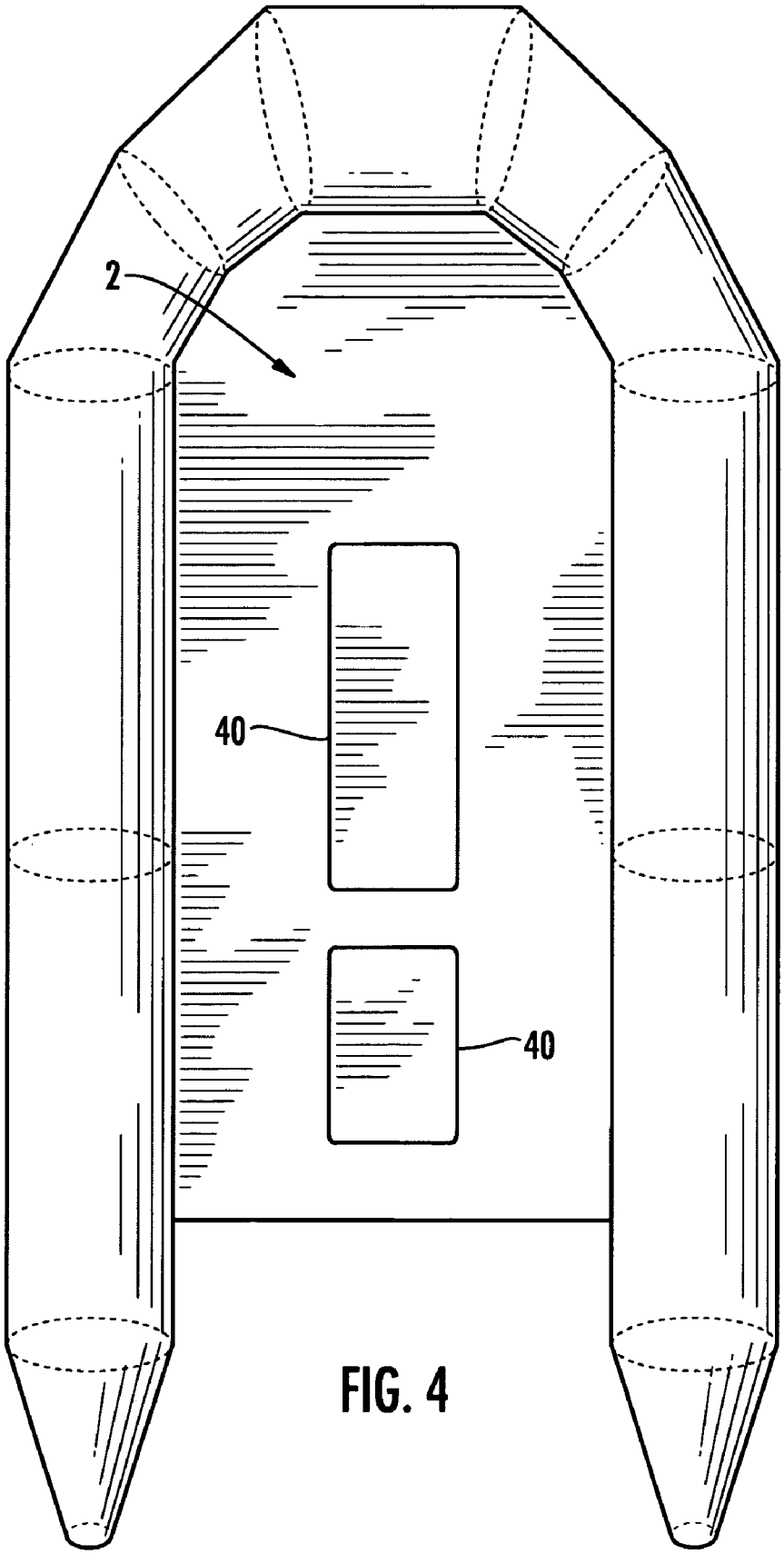
FIG. 4 is atop view of a vessel of the present invention.

FIG. 4 is a top view of the vessel 1 of FIG. 1. As illustrated in FIG. 4, the hull structure 2 provides tankage, internal propulsion, and/or storage 40 which may be located in the interior space provided by the sponson 8.

Figure 5:
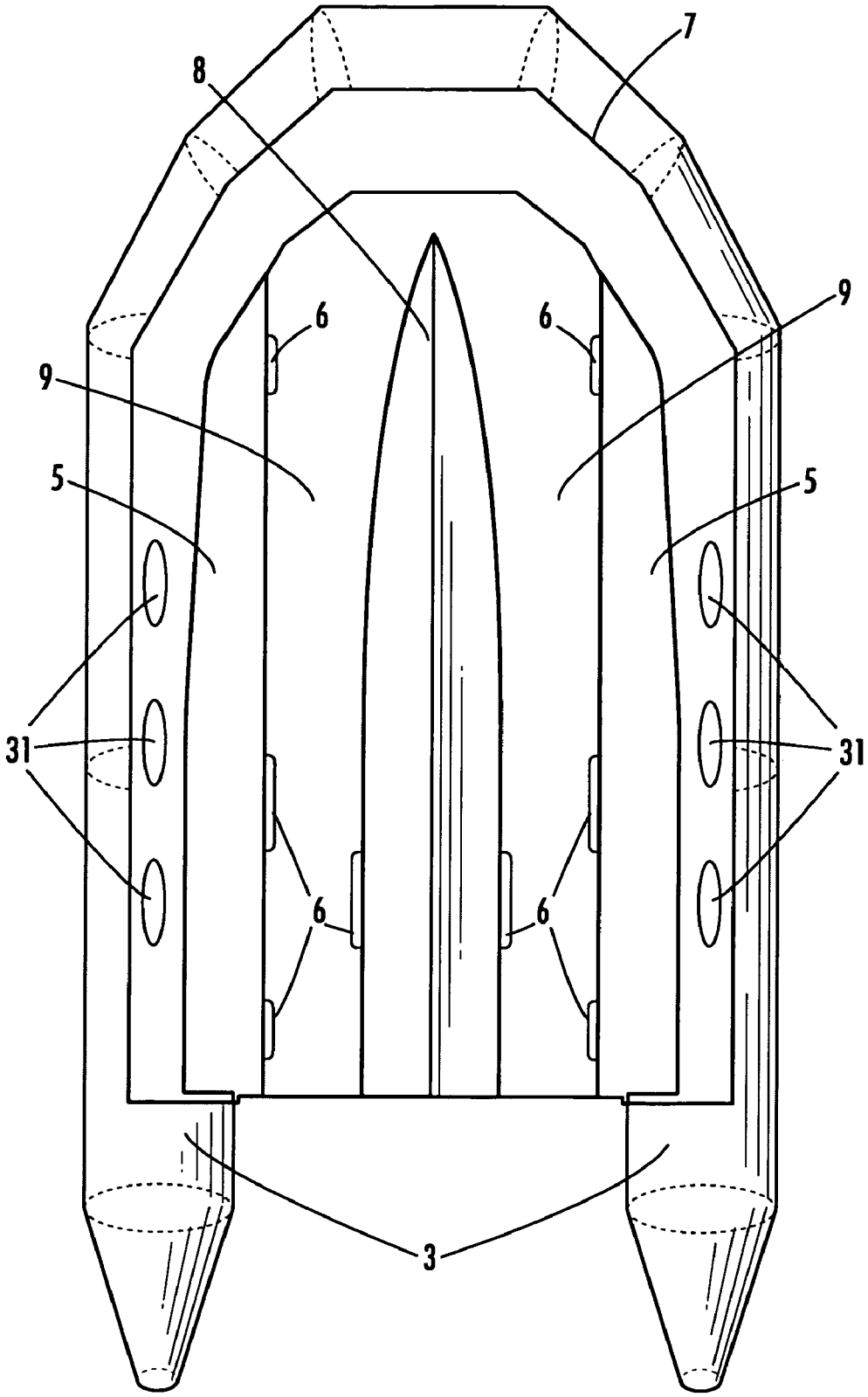
FIG. 5 is a bottom view of a vessel of the present invention.

FIG. 5 is a bottom view of a vessel 1 of the present invention. FIG. 5 illustrates the relative position of all of the underbody components of the vessel 1 including the collar 3, sponson 8, hollow ballast devices 5, twin air tunnels 9, spray rail 7, flow control blades 6, and the relief holes 31.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A vessel comprising:

at least one hull structure for partially submerged flotation in a body of water, wherein the hull structure comprises:

a main hull body; and at least two elongated hollow ballast devices fixed rigidly with the main hull body and extending in a laterally spaced fore and aft orientation substantially the full lengthwise extent of the main hull body, each of the ballast devices having fore and aft openings and comprising water relief holes such that:

each ballast device is at least partially submerged in and occupied by the body of water when in a resting condition of the vessel; and each ballast device is predominantly emptied of the water when the vessel is moving over the water so as to elevate the ballast devices in the water to travel over the water in a planed condition and to elevate the main hull body at an air space above the body of water, the ballast devices forming a seal with respect to the body of water when the vessel is moving over the water to channel air through the air space substantially only in a fore-to-aft direction and substantially preventing air from escaping laterally from the air space relative to the direction of movement.

2. The vessel according to claim 1, wherein the hull structure further comprises pontoon units.

3. The vessel according to claim 1, wherein the hull structure further comprises inflated units.

4. The vessel according to claim 1, wherein the hull structure further comprises catamaran hull units.

5. The vessel according to claim 1, wherein the hull structure further comprises trimaran hull units.

6. The vessel according to claim 1, wherein the hull structure is tubular, inflated, semi-rigid, rigid, or "U"-shaped.

7. The vessel according to claim 1, wherein the hollow ballast devices comprise keel structures.

8. The vessel according to claim 1, wherein the hull structure comprises a sponson on an underside of the hull structure forming tunnels between the sponson and the hollow ballast device.

9. The vessel according to claim 1, wherein there are only two elongated hollow ballast devices.

10. The vessel according to claim 1, wherein the vessel further comprises a spray rail.

11. The vessel according to claim 1, wherein the vessel further comprises a guide element.

12. The vessel according to claim 11, wherein the guide element is selected from the group consisting of flow control blades, keels, rudders, fins, winglets, and a combination thereof.

13. A vessel comprising:

at least one hull structure for partially submerged flotation in a body of water, wherein the hull structure comprises:

a main hull body;

at least two hollow ballast devices fixed rigidly with the main hull body and extending in a laterally spaced fore and aft orientation substantially the full lengthwise extent of the main hull body, wherein each ballast device has fore and aft openings and comprises water relief holes;

a sponson closed to water on an underside of the hull structure between the ballast devices forming tunnels between the sponson and one or more of the ballast devices;

wherein each ballast device is at least partially submerged in the water and occupied by the body of water when in a resting condition of the vessel; and wherein each ballast devices is predominantly emptied of the water when the vessel is moving over the water so as to elevate the ballast device in the water to travel over the water in a planed condition and to elevate the main hull body at least substantially above the body of water, the ballast devices forming a seal with respect to the body of water when the vessel is moving over the water to channel air through the tunnels substantially only in a fore-to-aft direction and substantially preventing air from escaping laterally from the tunnels relative to the direction of movement.

* * * * *